US007757618B2

(12) United States Patent
Chang

(10) Patent No.: US 7,757,618 B2
(45) Date of Patent: Jul. 20, 2010

(54) HEIGHT-ADJUSTABLE TABLE

(76) Inventor: Chien-Kuo Chang, 10-2 No. 447, 3 Sec. Wen-Hsin Rd., Taichung (TW) 406

( * ) Notice: Subject to any disclaimer, the term of this patent is extended or adjusted under 35 U.S.C. 154(b) by 441 days.

(21) Appl. No.: 11/952,099

(22) Filed: Dec. 6, 2007

(65) Prior Publication Data

US 2009/0145341 A1 Jun. 11, 2009

(51) Int. Cl.
*A47B 9/00* (2006.01)

(52) U.S. Cl. ..... 108/145; 108/147; 248/421

(58) Field of Classification Search ..... 248/421, 248/422, 292.12; 108/145, 147, 144.11, 108/146, 9, 10

See application file for complete search history.

(56) References Cited

U.S. PATENT DOCUMENTS 35,671 A * 6/1862 Corbett ..... 108/145
297,940 A * 4/1884 Klar ..... 108/145
1,866,450 A * 7/1932 Burnley ..... 108/9
2,555,575 A * 6/1951 Crayton ..... 108/10
4,383,486 A * 5/1983 Reineman et al. ..... 108/2
4,747,353 A * 5/1988 Watt ..... 108/146
4,817,220 A * 4/1989 Guttormsem ..... 5/611
5,039,054 A * 8/1991 Pai ..... 248/423
5,413,304 A * 5/1995 Kato ..... 248/421
6,038,986 A * 3/2000 Ransil et al. ..... 108/145
6,691,626 B2 * 2/2004 Warner ..... 108/145

* cited by examiner

*Primary Examiner*—Janet M Wilkens

(57) ABSTRACT

A height-adjustable table comprises a base mounted thereon with a fixed brace, a shiftable brace for supporting a table board, an auxiliary brace pivotally connected between the shiftable brace and the fixed brace, a swingable brace settled on the fixed brace wherein a plurality of positioning recesses that are arranged in a curved array are provided on the swingable brace, and one end of the swingable brace is pivotally fastened to the shiftable brace while an opposite end is fixed with a second controller, a first controller for controlling a positioning pin to be settled in or separated from one of the positioning recesses. Thus, the second controller can swing the swingable brace when the positioning pin is separated from the positioning recess, so as to adjust an altitude of the table board.

5 Claims, 6 Drawing Sheets

HEIGHT-ADJUSTABLE TABLE

BACKGROUND OF THE INVENTION

1. Technical Field

The present invention relates to tables and, more particularly, to a height-adjustable table that can be applied as a desk, a computer table or the like.

2. Description of Related Art

A known height-adjustable table is adjusted in a predetermined range to be adaptive to users with different heights so as to allow the users to use the table in healthy and comfortable postures. Especially, tables featuring ergonomic design may employ various technical means to achieve the mentioned height adjustability.

For example, a known height-adjustable table is disclosed in U.S. Pat. No. 6,540,191. Two sets of vertical stands are set abreast for supporting a computer desk surface. Each set of the stands comprises a telescoped threaded rod assembly and a telescoped smooth rod assembly, which are parallel to each other. At a top of the threaded rod assembly, a bevel gear set is provided for linking to a rotating handle bar. Thereupon, when a user rotates the rotating handle bar to extend or retract the telescoped threaded rod assembly, the corresponding telescoped smooth rod assembly is driven to extend or retract accordingly, so that the altitude of the computer desk surface can be adjusted. The inconvenience '191 patent may bring to the user includes that repeated rotating operation is required to adjust the computer desk surface to a desired altitude while the heavier the computer desk surface or the load thereupon is, the more laborious the operation is. Besides, since the two sets of the stands are adjusted separately, it would be difficult to set the computer desk surface levelly without employing an auxiliary level gauge, such as a spirit level.

SUMMARY OF THE INVENTION

The primary objective of the present invention is to provide a height-adjustable table.

To achieve this and other objects of the present invention, the height-adjustable table comprises a base mounted thereon with a fixed brace, a shiftable brace for supporting a table board, an auxiliary brace pivotally connected between the shiftable brace and the fixed brace, a swingable brace settled on the fixed brace, a plurality of positioning recesses that are arranged in a curved array provided on the swingable brace, a first swing arm of the swingable brace pivotally fastened to the shiftable brace, a second swing arm of the swingable brace fixed with a second controller, a first controller for controlling a positioning pin to be settled in or separated from one of the positioning recesses so that the second controller can swing the swingable brace when the positioning pin is separated from the positioning recess, and at least one spring fixed at the fixed brace for providing a downward repositioning pulling force so as to retain the positioning pin in one of the positioning recessed.

The first controller allows a user to operate the same with a single hand while the second controller allows the user to operate the same with a single foot so that an altitude of the table board can be adjusted by the user's simultaneous single-hand and single-foot operations.

The swingable brace of the present invention is a first-class lever that has a fulcrum located between an input effort and an output load. Thus, the second swing arm with an extended length facilitates effort-saving operation of the swingable brace.

BRIEF DESCRIPTION OF THE DRAWINGS

The invention as well as a preferred mode of use, further objectives and advantages thereof, will best be understood by reference to the following detailed description of an illustrative embodiment when read in conjunction with the accompanying drawings, wherein.

DETAILED DESCRIPTION OF THE PREFERRED

Figure 1:
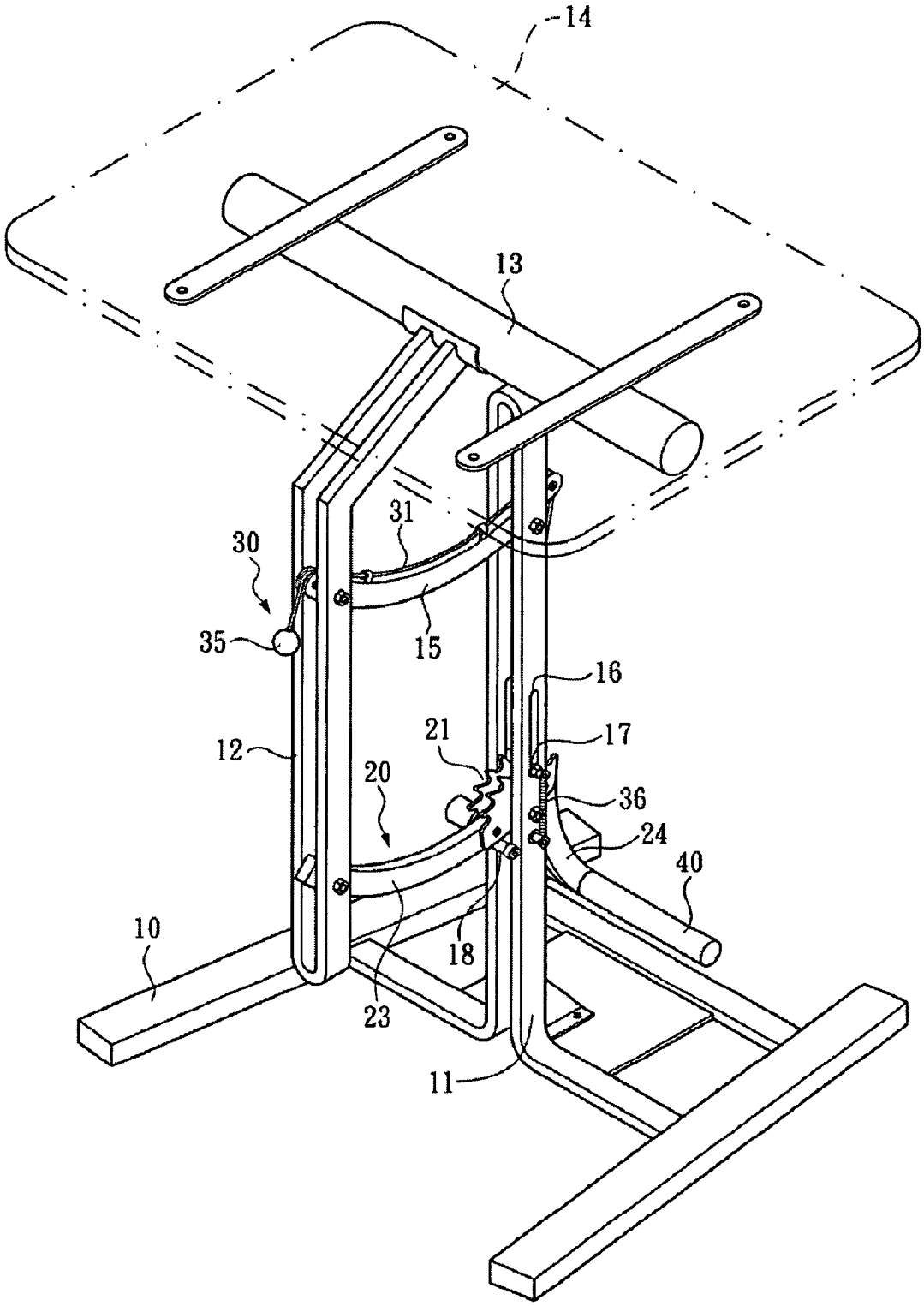
FIG. 1 is a perspective drawing of the disclosed subject matter.
Figure 2:
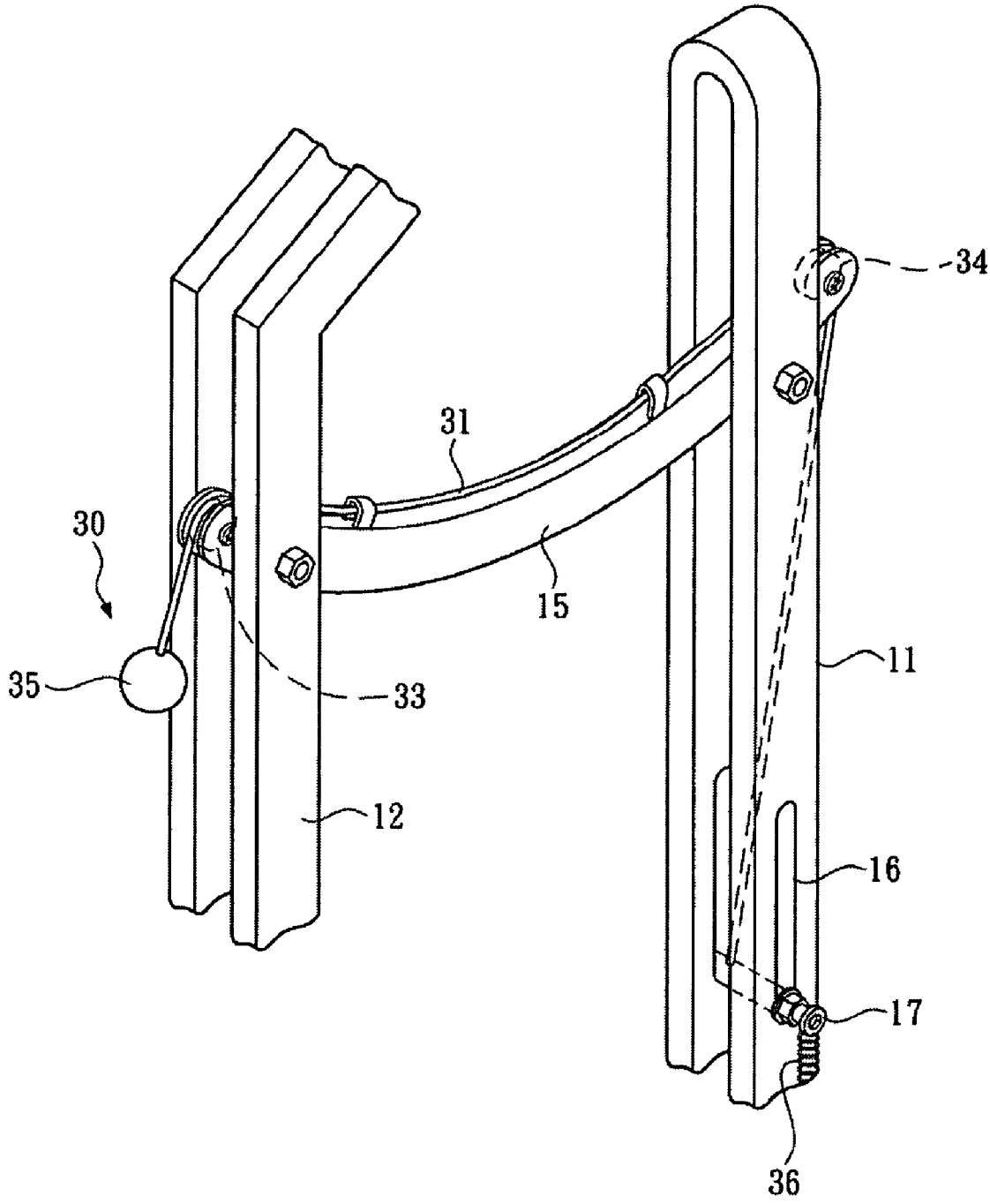
FIG. 2 is a perspective drawing of the first controller of the disclosed subject matter.
Figure 3:
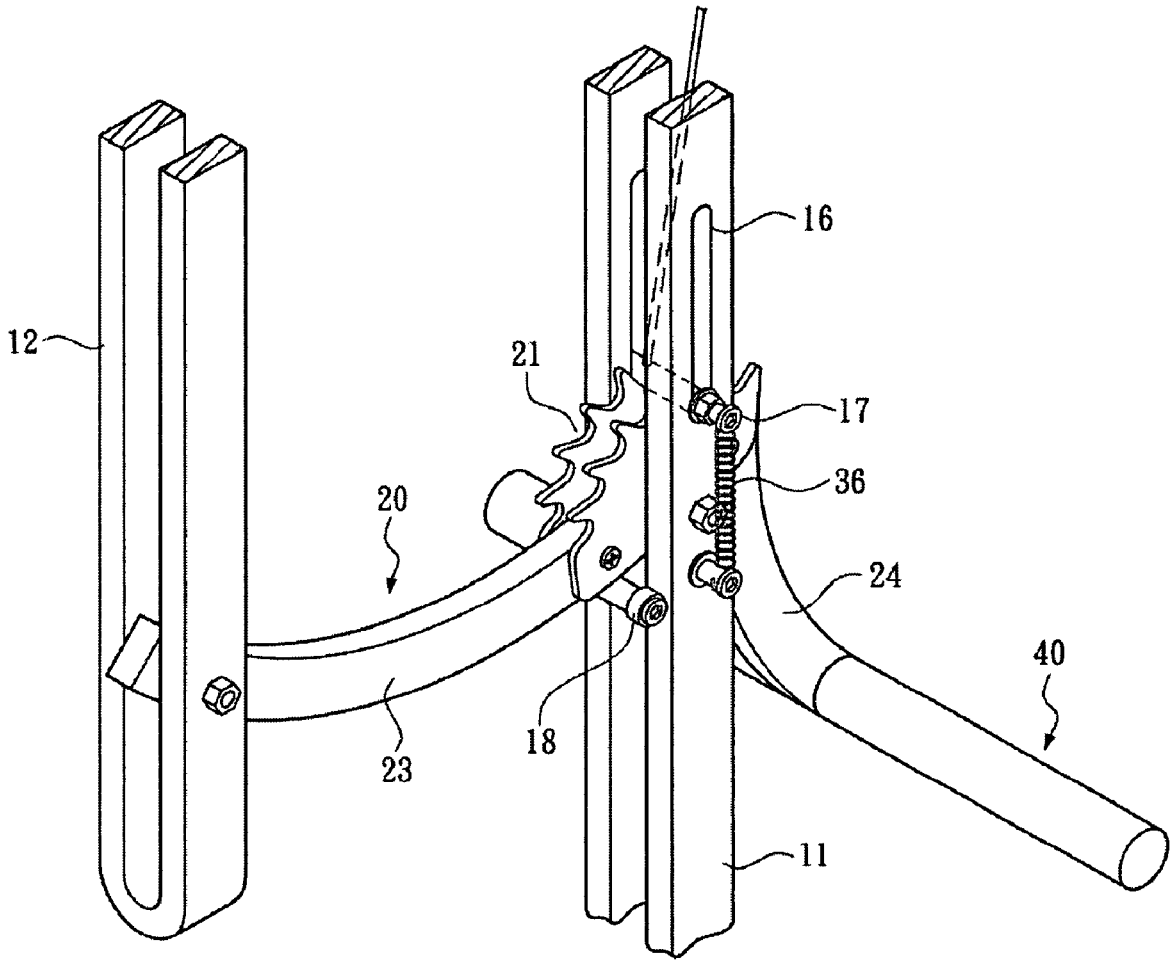
FIG. 3 is a perspective drawing of the swing support and the second controller of the disclosed subject matter.

As the drawings recited in the following embodiments are provided for illustrating the concept of the present invention as described above, it is to be understood that the deformation and displacement of the components in these drawings are made for better explanation and need not to be made in scale.

Please refer to FIGS. 1 through 4. A height-adjustable table of the present invention comprises a base 10, a fixed brace 11 mounted on the base 10; a shiftable brace 12 positioned at a lateral of the fixed brace 11, and a table board support 13 for supporting a table plate 14. Two ends of an auxiliary brace are pivotally fastened to the shiftable brace 12 and the fixed brace 11, respectively. A swingable brace 20 is pivotally fastened to the fixed brace 11 at a pivot point so to swing against the pivot point in responding to an external force acting thereon. The swingable brace 20 has a plurality of positioning recesses 21 that are formed at an upper edge corresponding to the fixed brace 11 and arranged in a curved array. The swingable brace 20 has a first swing arm 23 pivotally fastening to the shiftable brace 12 and has a second swing arm 24 provided with a second controller 40, which is a rod extending leftward and rightward from the swingable brace 20. The fixed brace 11 is Formed with a slot 16 for accommodating a positioning pin 17 therein. The positioning pin 17 can be controlled to move along the slot 16 by a first controller 30 so as to be settled in or separated from one of the positioning recesses 21. The first controller 30 comprises a control wire 31 that extends along the auxiliary brace 15. The control wire 31 passes around a first pulley 33 and a second pulley 34 settled at two ends of the auxiliary brace 15. Further, the control wire 31 has one end thereof provided with a handling member 35 and has one opposite end fixed at the positioning pin 17. Thus, when a user holds the handling member 35 to pull the control wire 31, the positioning pin 17 is driven to move upward and thus separated from the positioning recess 21. Two springs 36 are fixed at the fixed brace 11 for providing a downward repositioning pulling force to the positioning pin 17.

Figure 5:
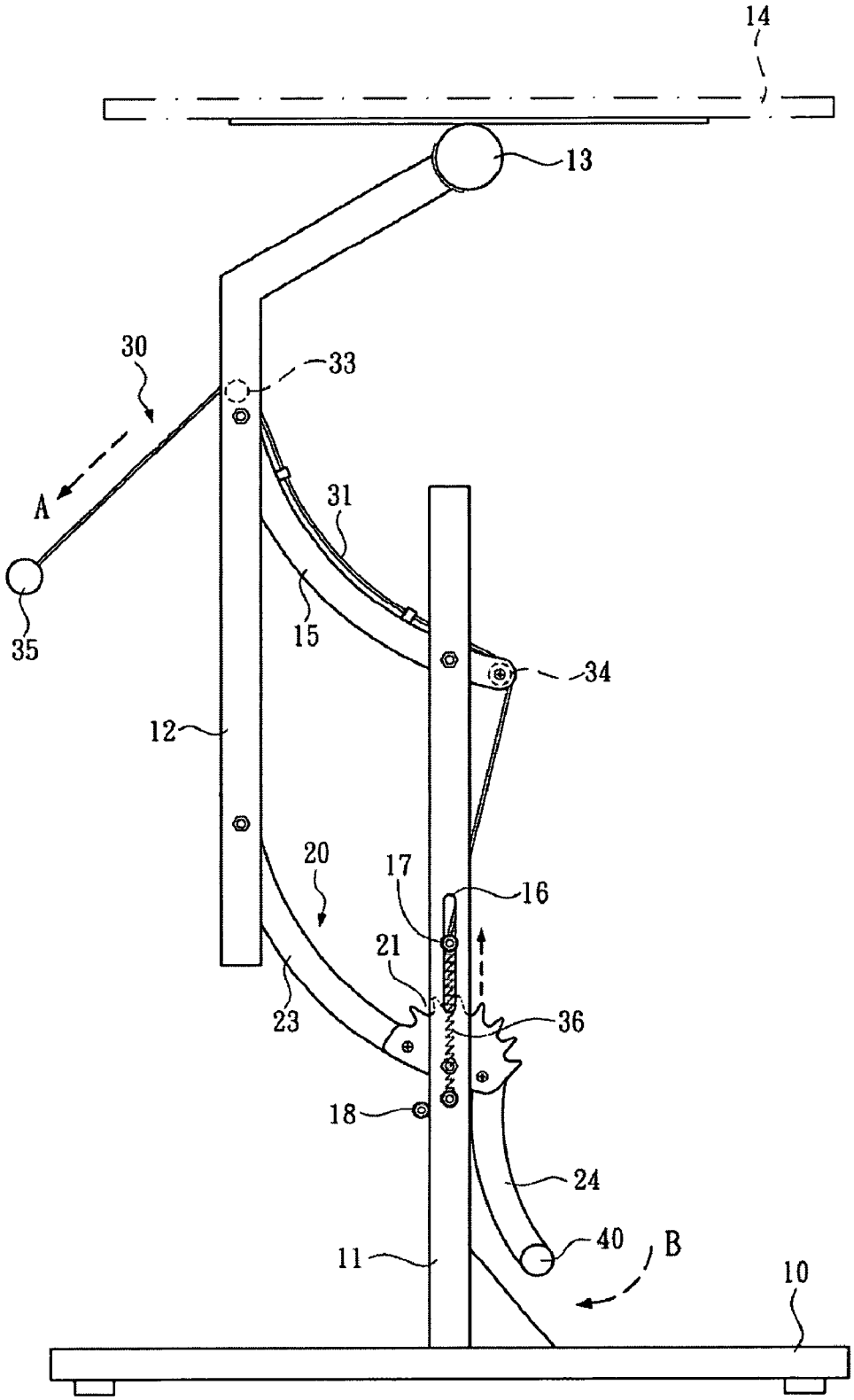
FIG. 5 is a schematic drawing showing the tabletop raised.

According to FIG. 5, when a user pulls the control wire 31, the control wire 31 in turn drives the positioning pin 17 to move upward along the slot 16 and depart from the positioning recess 21 of the swing brace 20. Meanwhile, the user can use his foot to exert a force onto the second controller 40, so as to swing the swingable brace 20 for the predetermined swing angle. Consequently, the shiftable brace 12 moves upward or downward correspondingly.

Figure 4:
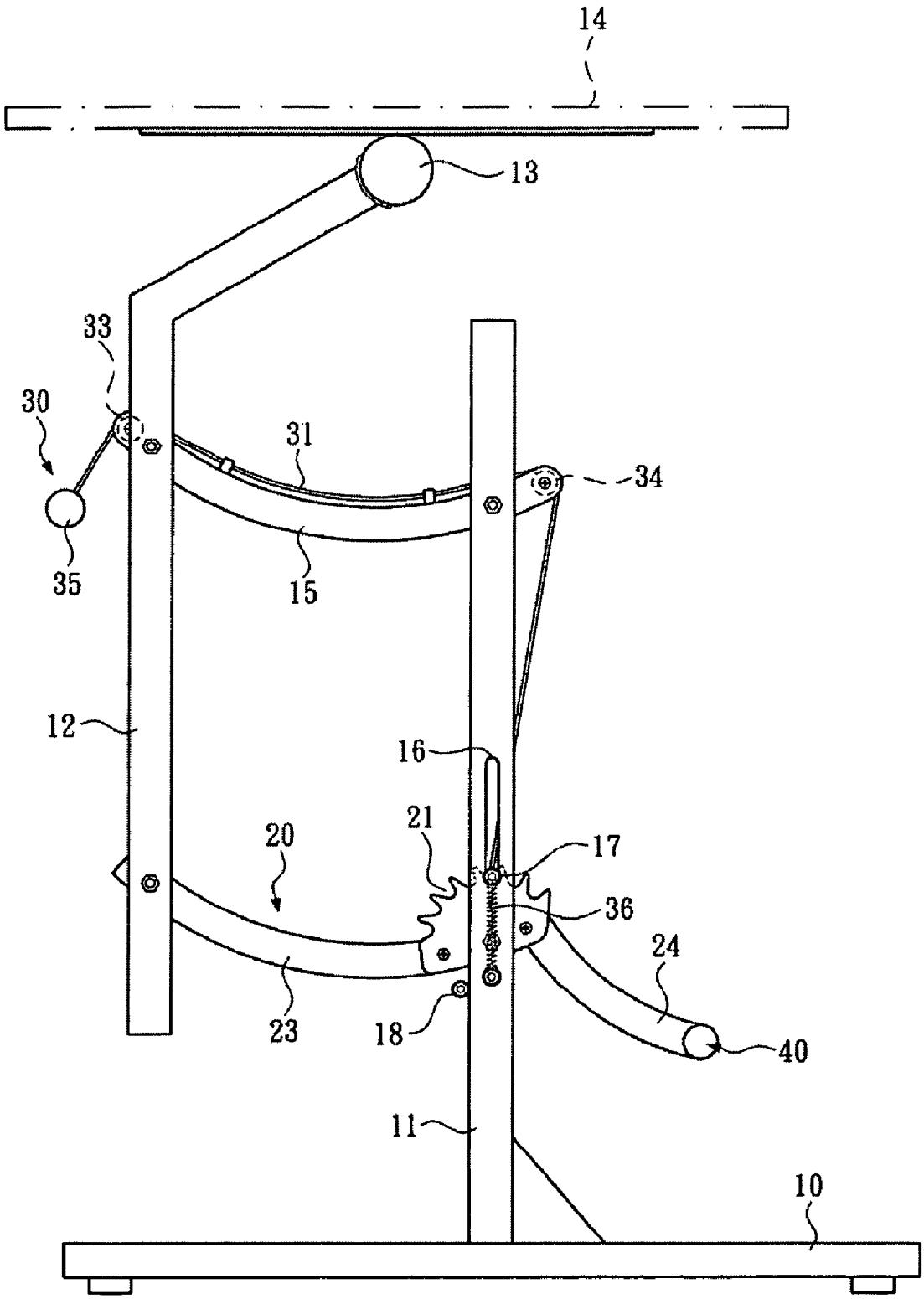
FIG. 4 is a side view of the disclosed table according to FIG. 1.

FIGS. 4 and 5 further explain the serial movements as described above. When the user pulls the control wire 31 along a direction indicated by Arrow A, the positioning pin 17 moves upward. Then when the user exerts a force to the second controller 40 along a direction indicated by Arrow B, the positioning pin 17 moves upward and the swingable brace 20 swings clockwise for a range, so as to raise the table board.

Figure 6:
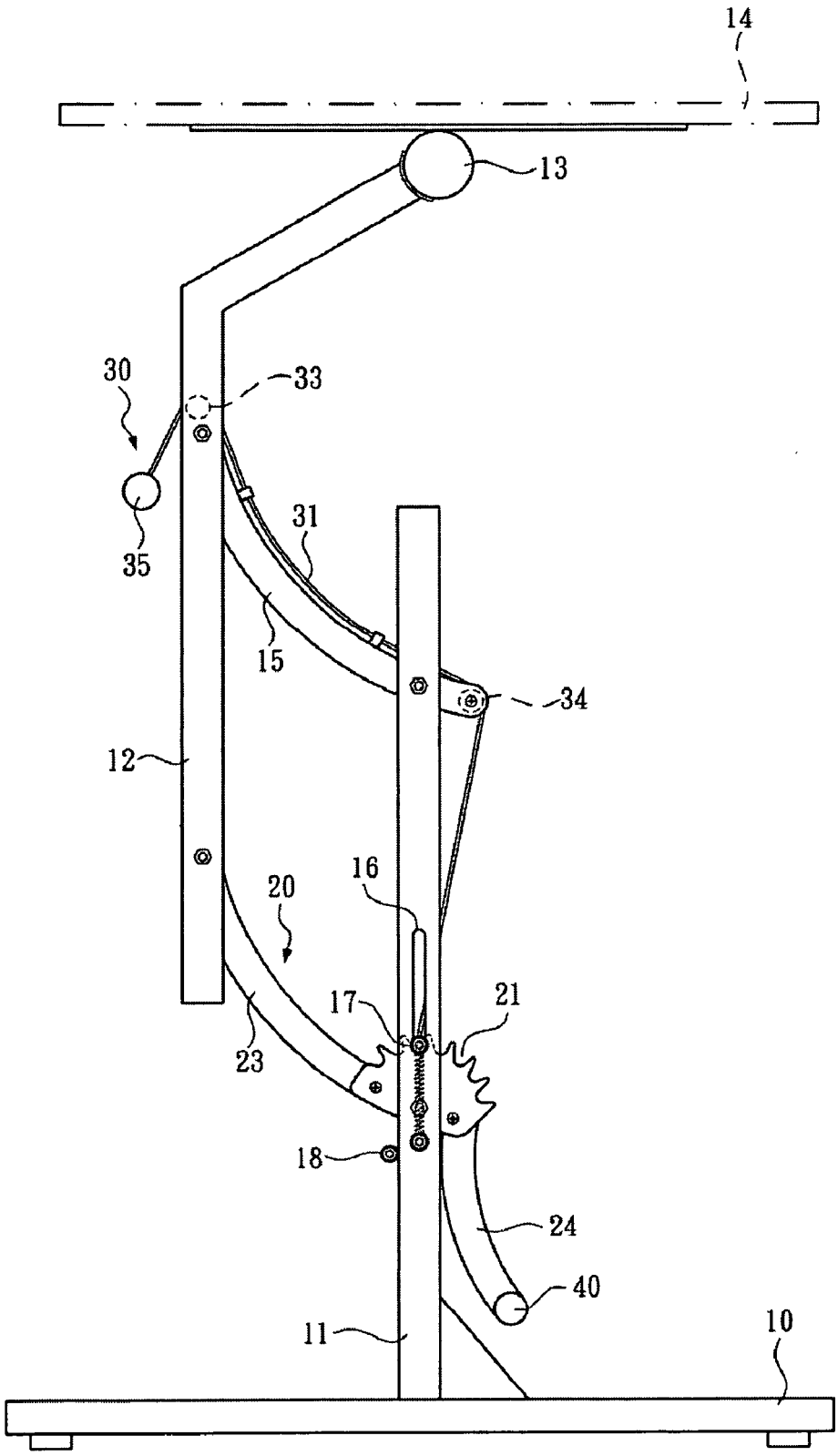
FIG. 6 is another side view of the disclosed table wherein the tabletop is fixed at the altitude shown in FIG. 5.

In FIG. 6, when the table board 14 is raised to a desired altitude, the user can release the control wire 31. At this time, the springs 36 resile to pull the positioning pin 17 downward along the slot 16 so that the positioning pin 17 is eventually repositioned and retained in the positioning recess 21 currently aligned thereto. Thereby, the swingable brace 20 is fixed by the positioning pin 17 and the shiftable brace 12 is in turn fixed by the swingable brace 20 so that the table board is fixed at the current altitude.

In the drawings, the first swing arm 23 of the swingable brace 20 is parallel to the auxiliary brace 15. A limit rod 18 is provided on the fixed brace 11 so that when the first swing arm 23 swings downward to a predetermined limit position, the limit rod 18 retains the first swing arm 23 to limit the swingable brace 20 from going any further along one direction. Additionally, the second swing arm 24 of the swingable brace 20 extends toward the base 10 so that when the second swing arm 24 swings downward to a predetermined limit position, the fixed brace 11 retains the second swing arm 24 to limit the swingable brace 20 from going any further along an opposite direction.

Although a particular embodiment of the invention has been described in detail for purposes of illustration, it will be understood by one of ordinary skill in the art that numerous variations will be possible to the disclosed embodiments without going outside the scope of the invention as disclosed in the claims.

What is claimed is:

1. A height-adjustable table, comprising:

a base;

a fixed brace mounted on the base;

a swingable brace, which is pivotally fastened to the fixed brace at a pivot point so to swing against the pivot point within an area defined by a predetermined angle, and has a plurality of positioning recesses that are arranged in a curved array;

a shiftable brace, which is pivotally fastened to a first swing arm of the swingable brace and has a table board mounted on a top thereof, a second controller, which is fastened to a second swing arm of the swingable brace for swinging the swingable brace;

an auxiliary brace, which is pivotally connected between the shiftable brace and the fixed brace;

a positioning pin, which is fastened to the fixed brace and is settled in or separated from one of the positioning recesses of the swingable brace in responding to an external force acting thereon; and a first controller for separating the positioning pin from the positioning recess so that the second controller can swing the swingable brace when the positioning pin is separated from the positioning recess.

2. The height-adjustable table of claim 1, wherein the first controller comprises a control wire that extends along the auxiliary brace, and passes around a first pulley and a second pulley settled at two ends of the auxiliary brace while the control wire has one end thereof provided with a handling member and has one opposite end fixed at the positioning pin, and at least one spring fixed at the fixed brace for providing a downward repositioning pulling force to the positioning pin.

3. The height-adjustable table of claim 1, wherein the second controller is a rod extending leftward and rightward from the swingable brace.

4. The height-adjustable table of claim 1, wherein a limit rod is provided on the fixed brace so that when the first swing arm swings downward to a predetermined limit position, the limit rod retains the first swing arm so to limit a swing angle of the swingable brace.

5. The height-adjustable table of claim 4, wherein the second swing arm of the swingable brace extends toward the base so that when the second swing arm swings downward to a predetermined limit position, the fixed brace retains the second swing arm so to limit the swing angle of the swingable brace.

* * * * *